US008925876B2

(12) United States Patent
Rubinstein

(10) Patent No.: US 8,925,876 B2
(45) Date of Patent: Jan. 6, 2015

(54) CRIB BABY BOTTLE HOLDER FOR SELF FEEDING

(71) Applicant: Allen Rubinstein, Staten Island, NY (US)

(72) Inventor: Allen Rubinstein, Staten Island, NY (US)

( * ) Notice: Subject to any disclaimer, the term of this patent is extended or adjusted under 35 U.S.C. 154(b) by 0 days.

(21) Appl. No.: 13/623,092

(22) Filed: Sep. 19, 2012

(65) Prior Publication Data

US 2013/0075541 A1 Mar. 28, 2013

Related U.S. Application Data

(60) Provisional application No. 61/538,927, filed on Sep. 25, 2011.

(51) Int. Cl.
*A47D 15/00* (2006.01)
*A61J 9/06* (2006.01)

(52) U.S. Cl.
CPC . *A47D 15/00* (2013.01); *A61J 9/06* (2013.01); *A61J 2009/0646* (2013.01); *A61J 2009/0661* (2013.01)
USPC ..... 248/104; 248/102; 248/103; 248/309.1

(58) Field of Classification Search
USPC ..... 248/102, 104, 205.2, 103, 309.1, 105, 248/106, 107, 910, 274, 231.6, 231.5
See application file for complete search history.

(56) References Cited

U.S. PATENT DOCUMENTS 1,567,225 A * 12/1925 Barbin ..... 248/102
1,630,167 A * 5/1927 Cardarella ..... 248/102
2,060,194 A * 11/1936 Gissubel ..... 248/102
2,110,037 A * 3/1938 De Rosa ..... 248/104
2,182,164 A * 12/1939 Rosenberg ..... 248/104
2,199,869 A * 5/1940 Baker et al. ..... 248/102
2,214,882 A * 9/1940 Eades ..... 248/102
2,399,320 A * 4/1946 Brose et al. ..... 248/104
2,448,189 A * 8/1948 Mott ..... 248/104
2,518,862 A * 8/1950 Cain et al. ..... 248/104
3,425,653 A * 2/1969 Rauch ..... 248/104
4,062,510 A * 12/1977 Brochu ..... 248/102
4,114,847 A * 9/1978 Bogensberger ..... 248/104
4,220,302 A * 9/1980 Hampton et al. ..... 248/102
4,718,623 A * 1/1988 McClure ..... 248/102
4,723,801 A * 2/1988 Musumeci et al. ..... 294/33
4,733,836 A * 3/1988 Barnes ..... 248/106
4,989,811 A * 2/1991 Millis et al. ..... 248/104
5,192,041 A * 3/1993 Bryant ..... 248/104
5,397,039 A * 3/1995 Parcelles ..... 224/148.5
5,582,335 A * 12/1996 Beard et al. ..... 224/148.5
5,603,479 A * 2/1997 Kristy ..... 248/548
5,613,657 A * 3/1997 Olaiz ..... 248/102
5,806,730 A * 9/1998 Deno ..... 224/148.6

(Continued)

*Primary Examiner* — Terrell McKinnon
*Assistant Examiner* — Monica Millner
(74) *Attorney, Agent, or Firm* — Israel Nissenbaum; Yitzy Nissenbaum

(57) ABSTRACT

A method and device for providing a child in a crib, with self access to a feeding bottle. A retaining receptacle, preferably insulative, for a baby bottle is provided with an open top and of an inner dimension suitable for accepting and retaining a baby bottle therein for child removal of the bottle by either lifting or tilting and dragging it out. The receptacle is provided with a releasable fastening element or elements such as hook and eye fasteners to enable the retaining receptacle to be securely fastened to one or more fixed position crib elements such as upright bars, slats or the frame to fixedly hold the retaining receptacle in an upright position at a position in the crib adjacent and accessible to a child placed therein.

15 Claims, 5 Drawing Sheets

(56) References Cited

U.S. PATENT DOCUMENTS

| | | | | |
|---|---|---|---|---|
| 5,823,486 | A * | 10/1998 | Smith et al. | 248/104 |
| 5,862,927 | A * | 1/1999 | Tebeau | 215/11.1 |
| 5,873,551 | A * | 2/1999 | Jones | 248/102 |
| 5,967,345 | A * | 10/1999 | Subotin | 211/119.007 |
| 6,138,882 | A * | 10/2000 | Buettner | 224/250 |
| 6,213,547 | B1 * | 4/2001 | Bowe et al. | 297/188.01 |
| 6,592,084 | B1 * | 7/2003 | Nile | 248/104 |
| 6,598,838 | B2 * | 7/2003 | Suh | 248/104 |
| 6,758,453 | B1 * | 7/2004 | Ralko | 248/311.3 |
| 6,971,612 | B1 * | 12/2005 | Wilson-Lowery | 248/104 |
| 6,978,918 | B2 * | 12/2005 | Scanlan et al. | 224/148.6 |
| 7,043,778 | B1 * | 5/2006 | Georgitsis et al. | 5/93.1 |
| 7,213,791 | B2 * | 5/2007 | Morris et al. | 248/102 |
| 7,275,729 | B2 * | 10/2007 | Sherman et al. | 248/311.2 |
| 7,472,871 | B1 * | 1/2009 | Demontegnac | 248/104 |
| D607,115 | S * | 12/2009 | Bellamy-Noseworthy et al. | D24/199 |
| 7,661,636 | B1 * | 2/2010 | Burke | 248/102 |
| D629,259 | S * | 12/2010 | Joy et al. | D7/624.2 |
| 8,132,683 | B2 * | 3/2012 | Rund et al. | 215/11.6 |
| 8,333,352 | B2 * | 12/2012 | Chambers | 248/104 |
| 2006/0081747 | A1 * | 4/2006 | Sherman et al. | 248/309.1 |
| 2007/0012822 | A1 * | 1/2007 | Bellamy-Noseworthy et al. | 248/104 |
| 2008/0093513 | A1 * | 4/2008 | Kunzelman | 248/102 |
| 2008/0230658 | A1 * | 9/2008 | Waits et al. | 248/104 |
| 2009/0189027 | A1 * | 7/2009 | Brown et al. | 248/104 |
| 2010/0224739 | A1 * | 9/2010 | Allen | 248/103 |
| 2012/0312935 | A1 * | 12/2012 | Kaufman | 248/104 |

* cited by examiner

CRIB BABY BOTTLE HOLDER FOR SELF FEEDING

FIELD OF INVENTION

This invention relates to systems and methods for holding a baby bottle that is used for self-feeding babies and toddlers and particularly to safe methods for baby self feeding.

BACKGROUND OF THE INVENTION

Baby bottles are generally available in several relatively standard volume sizes of about three to four ounces, usually used for infants, and larger eight to nine ounce bottles, usually used by older children for holding larger amounts of liquids, such as formula, milk, juices or water. The larger baby bottles, available from many sources, are roughly elongated and cylindrical in form, with a height of about seven inches and a diameter of about two to three inches; a size that young children are comfortable in handling. When a child is able to hold and drink from a bottle by itself, an adult generally gives the child the bottle, almost invariably of the larger size, when it demands a drink.

There are numerous devices available for holding baby bottles, which are often insulated and generally grippingly hold the bottle itself or are receptacles for holding the bottle. Such holders, however, are adapted, placed and configured for storage utilization by an adult. With such utilization either the bottle itself or a receptacle that holds the bottle is held by a strap or other holding element attached to a stroller, chair or other convenient location for keeping a bottle handy for the adult to provide to the child for feeding. As far as is known, no baby bottle holder, however, is available which is adapted for self-feeding use by the child in a crib (as used herein, the term "crib" also includes any enclosure for a child such as a playpen, carriage, bed with bed-guard and the like).

SUMMARY OF THE INVENTION

Generally, the present invention comprises a method, holding system and device to enable a child to feed itself without the helping presence of an adult. Children of a general age of up to about three or four years old sleep in cribs or similar protected enclosures. They are therefore unable, whether as a factor of extreme youth or as a result of their being confined in an enclosure, to obtain a bottle for feeding on their own. Accordingly, they are either directly fed by an adult or are given a bottle on demand (usually by crying). Simply placing a feeding bottle into a crib however is of little merit. It would be unreasonable to expect a child, often in a sleep-like stupor, to search his or her crib, often in total darkness, for his or her bottle. Furthermore, standing an elongated and cylindrical shaped bottle onto a soft and irregular surfaced mattress, which is constantly being nudged by the movement of the child thereon, would most likely cause the bottle to fall onto its side, roll about the crib and leak. The resulting moisture may cause discomfort or wake the child, soil the crib sheet or spoil and thus harbor germs. In accordance with the present invention, a designated and set location is able to be established for a child to intuitively and consistently check for his or her bottle while ensuring that the bottle will stand erect therein throughout.

In accordance with the method of the present invention, a child in a crib is provided with access to a feeding bottle in the crib by the steps of:

a. preparing a retaining receptacle with an open top and of an inner dimension suitable for accepting and retaining a baby bottle therein with minimal effort required to remove it from the receptacle through the open top by either lifting or tilting and dragging; and
b. providing the retaining receptacle with one or more releasable fastening elements, such as hook and eye fasteners, of a length and number sufficient to enable the retaining receptacle to be securely fastened to one or more fixed elements, such as upright bars, slats or the frame of a crib to fixedly hold the retaining receptacle in an upright position; and
c. fastening the bottle retaining receptacle to the inside of the crib by means of the fastening element or elements at a position of the crib adjacent and accessible to a child placed therein, preferably within the child's reach; and
d. placing a bottle containing a feeding fluid within the receptacle, whereby a child is able to remove the bottle from the receptacle to enable it to self feed itself.

The device of the present invention, as used in the method of permitting self feeding by a child confined in a crib, comprises a receptacle for holding a baby bottle, with the walls of the receptacle being spaced from the bottle for a sufficient distance for the bottle to be tilted and dragged out of the receptacle by the child. The height of walls of the receptacle, in conjunction with the degree of spacing of the bottle from the walls of the receptacle, is sized to permit the tilting and drag out removal of the bottle from the receptacle with minimal impedance. The height of the receptacle should be at least sufficient to prevent the bottle from too easily toppling out.

Other objects, features and advantages of the present invention will become more evident from the following discussion and drawings in which:

SHORT DESCRIPTION OF THE DRAWINGS

DETAILED DESCRIPTION OF THE INVENTION

Figure 1:
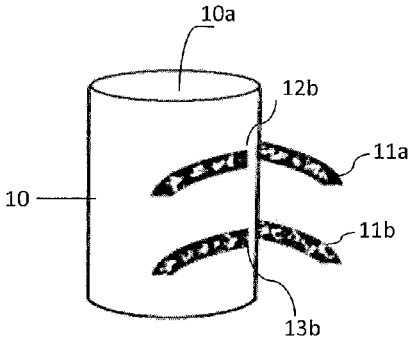
FIG. 1 is a perspective side view of the bottle receptacle with strips of a hook and eye fastener being threaded into slots therein.

The receptacle, since it is placed directly within the crib, should be of a soft, non-toxic material, which would not harm the child if the child either bumps into it while sleeping or attempts to gnaw on it. Preferably, the receptacle should be rounded, without corners, and should be soft and not constructed of a hard material such as rigid plastic. Hard materials may, however, be utilized if they are securely covered with a padded element which cannot be removed by the child. It is also preferred that the material have insulating characteristics in order to maintain freshness of content, even when a bottle is retained therein for prolonged periods. A suitable material for the receptacle is a resilient, non-toxic foam, vinyl, silicon or rubber based material, with the receptacle preferably being cylindrical in shape.

The materials used for the receptacle should either inherently, or by reinforcement, be configured to resist the pressures exerted by the child while removing the bottle or playing with the receptacle. Particular stress points are the lip of the receptacle, which the bottle comes into contact with when it is tilted and dragged from the receptacle, and the contact point or points between the receptacle and the anchoring fastening element or fastening elements. It is preferred, for increased structural integrity of the engagement between receptacle and the fastening elements, that the fastening elements be integrated with the receptacle such as by being individually drawn through apertures or slots in the receptacles in the manner of threading, wherein the fastening element is drawn in and out of the receptacle wall at two different positions.

The releasable fastening element or elements should also be short enough and have sufficient bulk to prevent entanglement with the child and also not present any type of choking hazard should it work loose. The fastening element should also preferably not be readily detachable from the receptacle nor should it have detachable small parts such as buttons or clips. A preferred type of fastener, is a length of dual sided hook and eye fastener on a fabric base. It is preferred that the fastener should be drawn through parallel closely spaced longitudinal slots in the side of the receptacle.

The inner height of the receptacle should be sufficient to retain a bottle therein without tipping but should not be excessively high whereby it may prevent or retard the child from removing the bottle contained therein. Generally, the inner height of the retaining receptacle is in a range of between about one third to about two thirds the height and preferably about half the height of a standard seven inch bottle (i.e., between about a little more than two and a half inches to about five and a quarter inches in height and preferably about three and a half inches in height).

The diameter of the aperture of the receptacle area should be generously more than the diameter of the bottle itself, in contrast to standard insulating bottle holders, which generally provide a snug fit. A similar snug fit with the bottle receptacle would tend to retard bottle removal from the receptacle by children unable to lift a bottle out of the receptacle, but who tilt and drag the bottle from the receptacle. An inner diameter of between about 2.5 to 3.25 inches is preferable, to permit easy removal of the bottle, while preventing the bottle from being accidentally dislodged, and while retaining its insulating qualities.

For older or more dexterous children, the receptacle should be configured to enable the child to replace the bottle within the receptacle for subsequent easy feeding use or storage.

Figure 2:
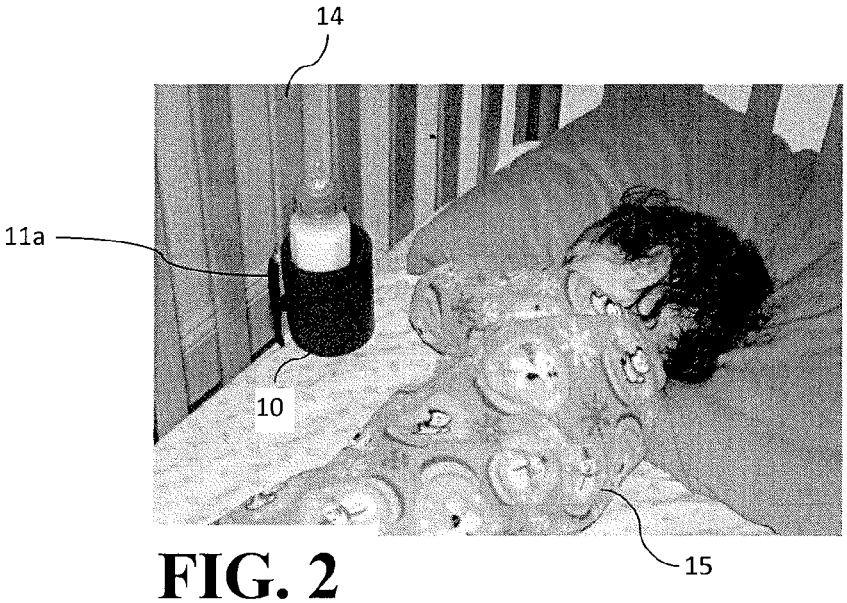
FIG. 2 is a view of the inside of a crib with a child therein, showing the placement of the bottle receptacle with bottle at a position accessible by the child for removal of the bottle.
Figure 4:
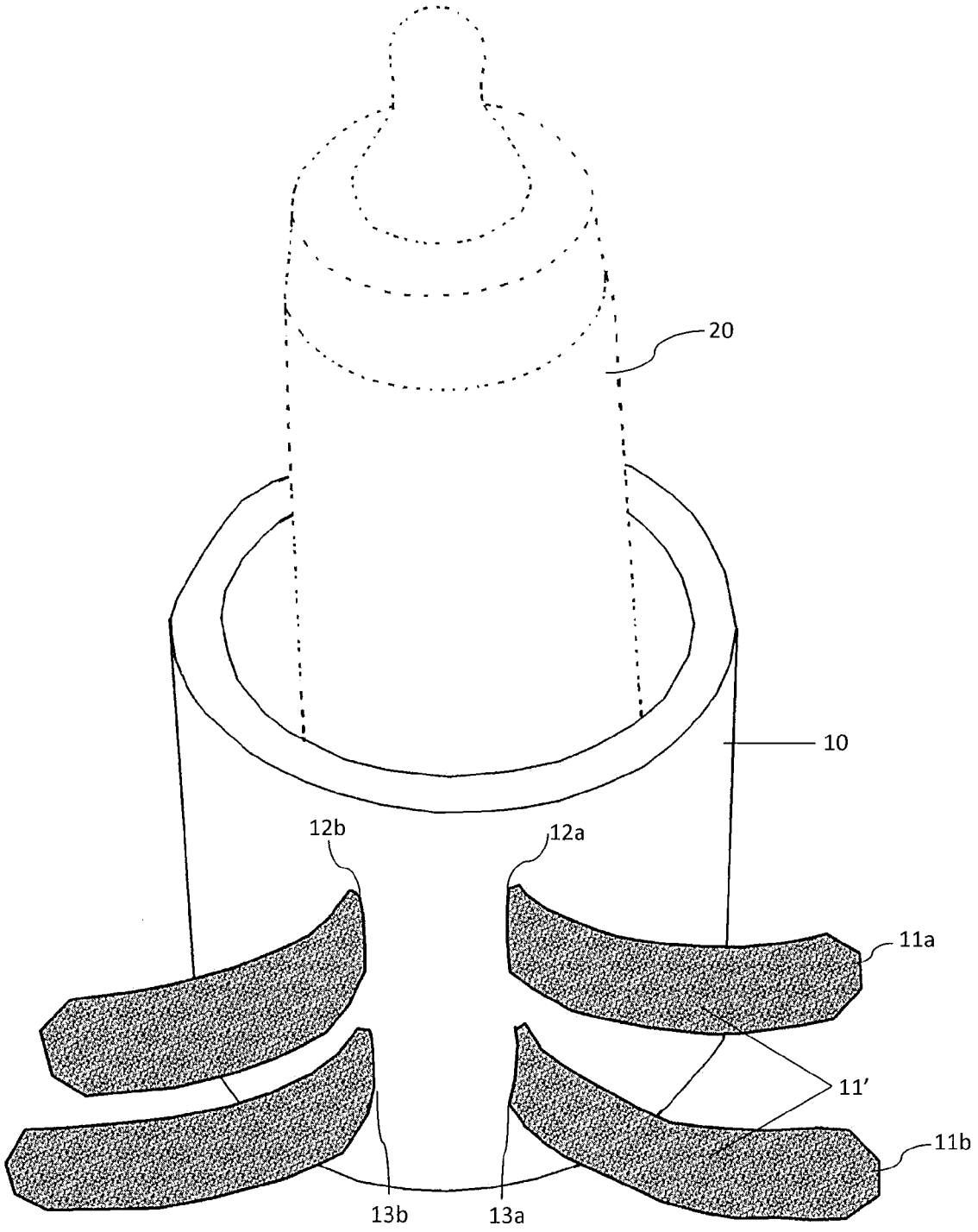
FIG. 4 is a rear perspective top view of the bottle in the bottle receptacle of FIG. 3.
Figure 6:
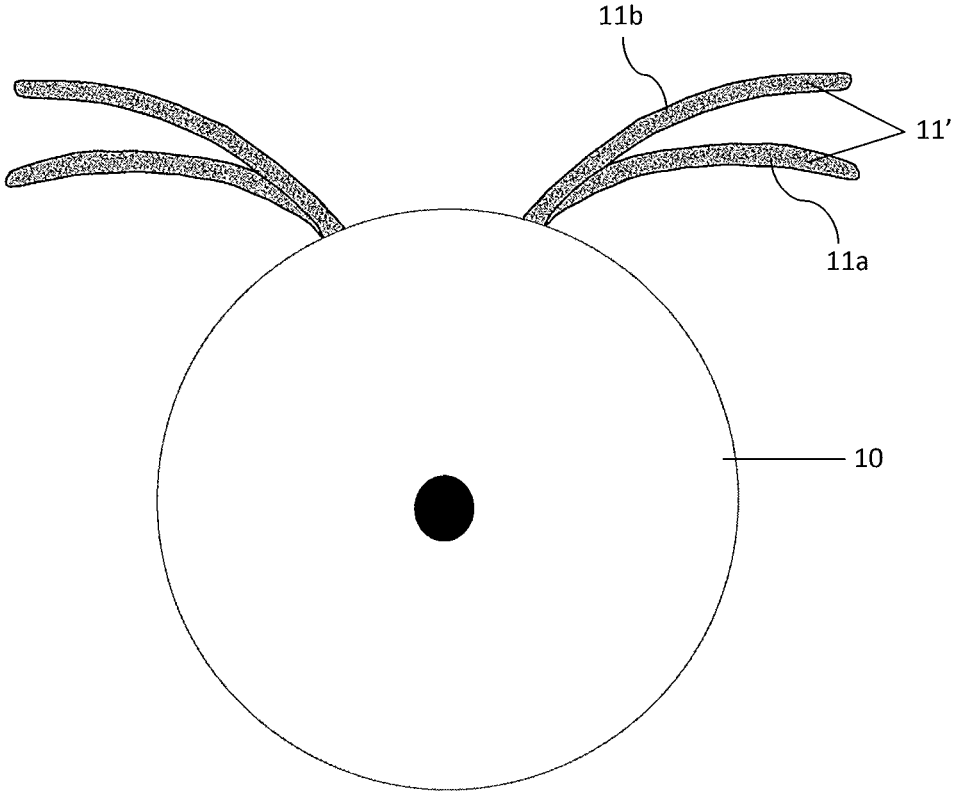
FIG. 6 is a bottom view of FIG. 3 without the bottle.

With specific reference to the drawings, a baby bottle receptacle 10, with a rounded configuration for safety, is shown in FIG. 1, with an open top 10*a* into which a bottle is insertable. As shown in FIG. 4, two hook and eye strips 11*a* and 11*b* having hooks on one side and cooperative eyes on the other are each respectively drawn through a pair of slit apertures 12*a*, 12*b* and 13*a*, 13*b*, in bottle receptacle 10. As shown in FIG. 2, the receptacle 10 is fastened by means of the hook and eye strips to a slat 14 of a crib at a position within arms reach of sleeping child 15, in a position convenient for self feeding by the child. Only a rounded protrusion extends into the crib and with a soft exposed contact area.

Figure 3:
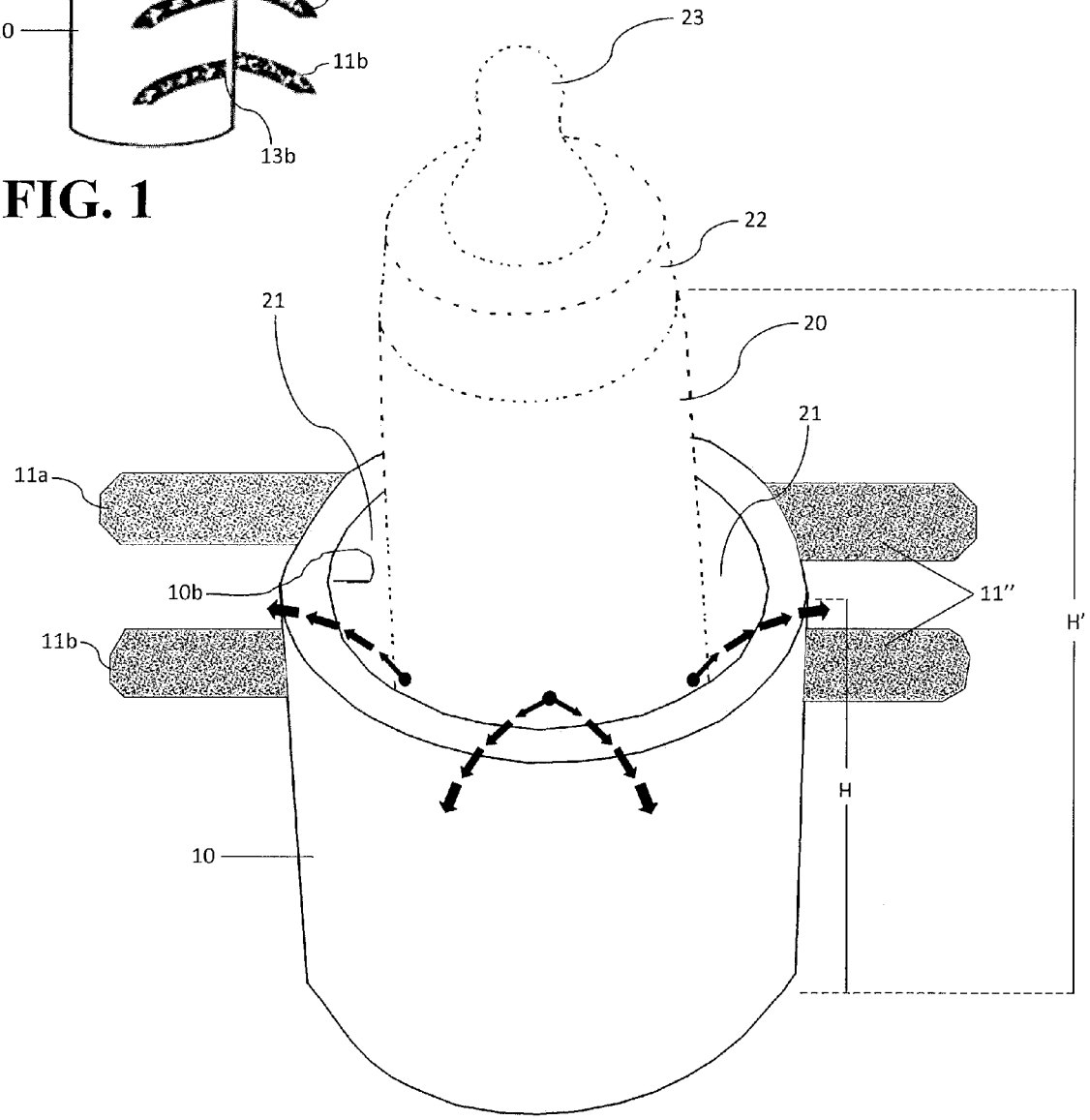
FIG. 3 is a front perspective view from above showing the bottle in dotted lines as placed initially in the bottle receptacle.
Figure 7:
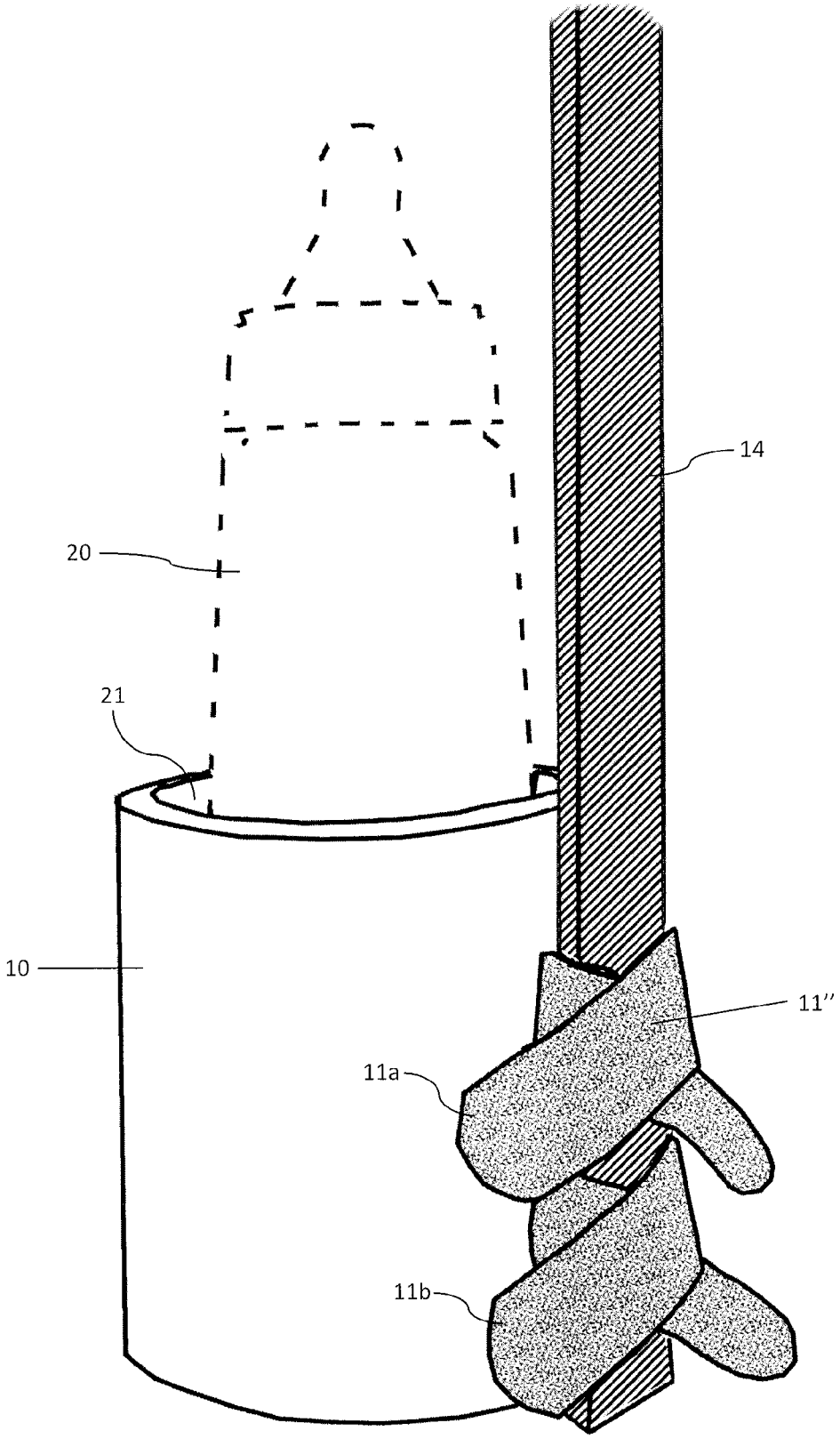
FIG. 7 is a perspective side view of the bottle and holder of FIG. 3 as being fastened to a bar of a child's crib.

In FIGS. 3 and 7, the rounded receptacle 10 is shown as containing baby bottle 20, with the bottle 20 being spaced from the inner walls of the receptacle 10*b* with about a half inch spacing 21 on either side and wherein the inner height of the walls of the receptacle H is about half of the height H' of the fluid containing bottle (not counting the height of the nipple 23), whereby the bottle 20 can be tilted in the direction shown by the arrows and dragged out by the child against the flexible material of the receptacle 10.

Figure 5:
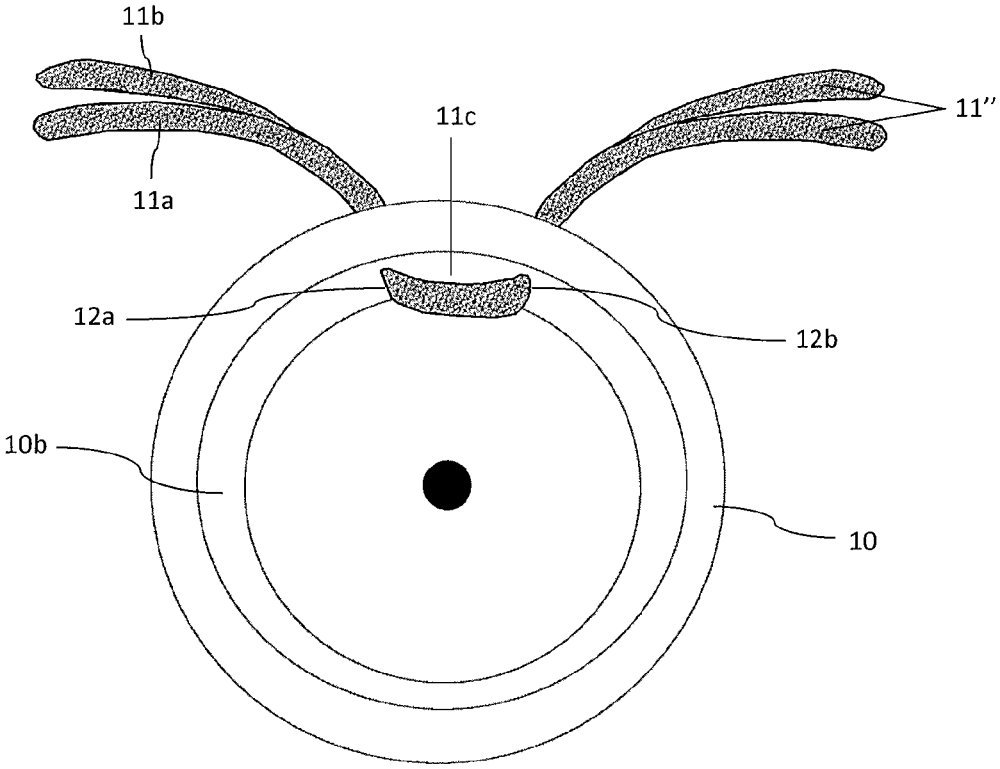
FIG. 5 is a top view of FIG. 3 without the bottle.

As is more clearly evident from FIGS. 3-6, the hook and eye straps 11*a* and 11*b* extend through the slit aperture pairs 12*a*, 12*b* and 13*a*, 13*b* respectively, and extend for a short distance beyond the outer perimeter 10*a* of receptacle 10. As seen in FIG. 5, neither of the hook and eye straps 11*a* and 11*b* (hooks 11' and eyes 11") are attached to an anchoring base and integrally provide their own base with the interleaved segment 11*c* which bears against the inner surface 10*b* of the receptacle wall to provide the anchoring to the crib bar, slat, or frame.

FIG. 7 shows the releasable hook and eye connection of the straps 11*a* and 11*b* by the overlapping engagement of the hooks of one side of the strap with the eyes of the other side. It is, of course, understood, that such engagement, while preferred because of ease and economy, may be replaced by other engagement means such as a belt type or a simple ribbon bow.

If a hard plastic or similar material is used for the receptacle, it should be tightly covered or clad with a soft layer material such as of foam to alleviate any concerns of the child being harmed by bumping into a hard object in a crib.

It is understood that the above description and drawings are merely exemplary of the present invention and that changes may be made in the structure of the device and system and the method of its use without departing from the scope of the invention as defined in the following claims.

What is claimed is:

1. A method for providing a child in a crib with self feeding access to an elongated feeding baby bottle, with the crib comprising:

at least one side enclosure wall comprised of at least one vertically extending bar element, and a mattress being located adjacent the base of the side enclosure wall and extending within the crib in a direction substantially perpendicular thereto, with the child being placed on the mattress, the method comprising the steps of:

a) fastening an elongated feeding baby bottle retaining receptacle, having a closed bottom and an open top, to the at least one vertically extending bar element on the inside of the crib with a releasable fastening element at a vertical position adjacent the mattress and adjacent the child placed therein, the retaining receptacle comprising a baby bottle retaining portion having the open top and an inner dimension of the retaining portion suitable for accepting and retaining the baby bottle with feeding fluid therein, in an upright position;

b) positioning and fastening the retaining receptacle with the releasable fastening element in an upright position with the open top being accessible for placement of the feeding bottle into the retaining receptacle in said upright position; and c) placing the elongated feeding baby bottle, with feeding fluid therein, into the retaining receptacle in an upright position, with the baby bottle being at a position of the crib adjacent and accessible to a child placed therein, whereby a child is able to remove the bottle from the receptacle to enable it to self feed itself and wherein the retaining receptacle comprises walls which are spaced from the baby bottle, when placed therein, by a distance sufficient for the child to tilt the bottle and drag it out of the receptacle.

2. The method of claim 1, wherein a height of the walls of the retaining receptacle is configured to prevent the bottle placed within the receptacle from falling out of the receptacle when tilted and the height being less than that of the bottle by an amount sufficient to permit the child to tilt and drag the bottle out of the receptacle.

3. The method of claim 1, wherein the releasable fastening element or elements is provided to the retaining receptacle by being passed through the wall of the receptacle into the receptacle at one point and passed through the wall of the receptacle out of the receptacle at a second point.

4. The method of claim 1, wherein the retaining receptacle is comprised of a soft outer surface configured to prevent harm to the child upon child contact therewith.

5. The method of claim 1, wherein the retaining receptacle is comprised of a curved outer surface without sharp edges to prevent harm to the child upon child contact therewith.

6. The method of claim 3, wherein the releasable fastening element comprises at least one strip, comprised of fabric with one side having hooks and the other side having eyes.

7. The method of claim 4, wherein the retaining receptacle is comprised of an insulating material.

8. A receptacle device configured for upright attachment of an elongated feeding baby bottle to a crib providing self feeding access to the elongated feeding baby bottle with feeding fluid therein, the receptacle device having a receptacle retaining portion with an open top and a closed bottom and an inner dimension of the retaining portion configured for accepting and retaining the baby bottle in an upright position, with walls of the retaining portion of the receptacle device being spaced from the feeding baby bottle when placed therein, by a distance wherein tilting the feeding baby bottle allows the feeding baby bottle to be removed from the receptacle device for self feeding; the receptacle device further comprising at least one releasable fastening element configured for releasable attachment to a fixed position element of the crib within the crib, with the receptacle device being further configured to be releasably attached to the fixed position element in the upright position with the open top being accessible for placement of the feeding baby bottle therein and with the receptacle device being adjacent a mattress within the crib;

with the crib comprising:

at least one side enclosure wall comprised of at least one vertically extending bar element which comprises the fixed position element, and the mattress being located adjacent the base of the side enclosure wall and extending within the crib in a direction substantially perpendicular thereto, and wherein a child is placed on the mattress adjacent the receptacle device.

9. The receptacle device of claim 8, wherein a height of the walls of the retaining receptacle is configured to prevent the bottle placed within the receptacle from falling out of the receptacle when tilted and the height being less than that of the bottle by an amount sufficient to permit the child to tilt and drag the bottle out of the receptacle.

10. The receptacle device of claim 8, wherein the releasable fastening element is provided to the retaining receptacle by being passed through the wall of the receptacle into the receptacle at one point and passed through the wall of the receptacle and out of the receptacle at a second point.

11. The receptacle device of claim 8, wherein the retaining receptacle is comprised of a soft outer surface configured to prevent harm to the child upon child contact therewith.

12. The receptacle device of claim 8, wherein the retaining receptacle is comprised of a curved outer surface without sharp edges to prevent harm to the child upon child contact therewith.

13. The receptacle device of claim 10, wherein the releasable fastening element comprises at least one strip comprised of fabric with one side having hooks and the other side having eyes.

14. The receptacle device of claim 8, wherein the retaining receptacle is comprised of an insulating material.

15. The method of claim 1 wherein the baby bottle is positioned within the crib whereby a child is able, while in a lying position, to remove the bottle from the receptacle to enable it to self feed itself.

* * * * *